US011747751B2

(12) United States Patent
Matsuzaki et al.

(10) Patent No.: US 11,747,751 B2
(45) Date of Patent: Sep. 5, 2023

(54) IMAGE FORMING APPARATUS WITH A REDUCED DIMENSION IN A HORIZONTAL DIRECTION

(71) Applicant: FUJIFILM BUSINESS INNOVATION CORP., Tokyo (JP)

(72) Inventors: Yoshiki Matsuzaki, Kanagawa (JP); Chihiro Iijima, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/585,048

(22) Filed: Jan. 26, 2022

(65) Prior Publication Data

US 2023/0068807 A1 Mar. 2, 2023

(30) Foreign Application Priority Data

Aug. 25, 2021 (JP) ..... 2021-137623

(51) Int. Cl.
*G03G 15/16* (2006.01)
*G03G 15/01* (2006.01)

(52) U.S. Cl.
CPC ..... *G03G 15/1615* (2013.01); *G03G 15/0142* (2013.01); *G03G 15/0178* (2013.01); (Continued)

(58) Field of Classification Search
CPC ..... G03G 15/0142; G03G 15/0178; G03G 2215/00016; G03G 2215/0103; (Continued)

(56) References Cited

U.S. PATENT DOCUMENTS 8,126,380 B2 2/2012 Kawano et al.
10,859,950 B2 12/2020 Ino et al.
(Continued)

FOREIGN PATENT DOCUMENTS

JP S63-011967 A 1/1988
JP H05-084972 A 4/1993
(Continued)

OTHER PUBLICATIONS

Nov. 25, 2022 Search Report issued in European Patent Application No. 22166244.8.

*Primary Examiner* — Joseph S Wong
(74) *Attorney, Agent, or Firm* — Oliff PLC

(57) ABSTRACT

An image forming apparatus includes a formation target that is wound around rotating bodies including a driving roller and transported by the rotating bodies including the driving roller while forming a shape having linear portions each of which forms a different angle, which is an acute angle or an angle of zero degrees, with a horizontal direction when viewed in an axial direction of the driving roller, first image forming bodies that are arranged along one of the linear portions in such a manner as to be spaced apart from each other by a first distance and that form images onto the formation target, and second image forming bodies that are arranged along another one of the linear portions, the other linear portion forming the angle larger than the angle formed by the one linear portion, in such a manner as to be spaced apart from each other by a second distance shorter than the first distance and that form images onto the formation target.

20 Claims, 3 Drawing Sheets

(52) U.S. Cl.
CPC ..... *G03G 2215/00016* (2013.01); *G03G 2215/00139* (2013.01); *G03G 2215/0103* (2013.01); *G03G 2215/0119* (2013.01); *G03G 2215/0125* (2013.01); *G03G 2215/0135* (2013.01); *G03G 2215/0141* (2013.01); *G03G 2215/0145* (2013.01); *G03G 2215/0148* (2013.01)

(58) Field of Classification Search
CPC ... G03G 2215/0119; G03G 2215/0125; G03G 2215/0135; G03G 2215/0141; G03G 2215/0145; G03G 2215/0148
See application file for complete search history.

(56) References Cited

U.S. PATENT DOCUMENTS

| | | | | |
|---|---|---|---|---|
| 2003/0108366 | A1 | 6/2003 | Yamada et al. | |
| 2007/0248387 | A1* | 10/2007 | Iwamoto ..... | G03G 15/011 399/302 |
| 2009/0087203 | A1* | 4/2009 | Udagawa ..... | G03G 15/6564 399/45 |
| 2010/0310281 | A1* | 12/2010 | Miura ..... | G03G 15/0131 399/298 |
| 2011/0085826 | A1 | 4/2011 | Yoon et al. | |

FOREIGN PATENT DOCUMENTS

| | | | |
|---|---|---|---|
| JP | 2001-246779 | A | 9/2001 |
| JP | 2002-108045 | A | 4/2002 |
| JP | 2007-003690 | A | 1/2007 |
| JP | 2009-080325 | A | 4/2009 |
| JP | 2020-144276 | A | 9/2020 |

* cited by examiner

IMAGE FORMING APPARATUS WITH A REDUCED DIMENSION IN A HORIZONTAL DIRECTION

CROSS-REFERENCE TO RELATED APPLICATIONS

This application is based on and claims priority under 35 USC 119 from Japanese Patent Application No. 2021-137623 filed Aug. 25, 2021.

BACKGROUND

(i) Technical Field

The present disclosure relates to an image forming apparatus.

(ii) Related Art

The image forming apparatus disclosed in Japanese Unexamined Patent Application Publication No. 63-11967 includes an annular belt that transports a sheet on which images are to be formed (a formation target) and that is caused to move along a circular path by a driving roller. A plurality of image forming bodies that form images onto the sheet are arranged around the annular belt so as to face an upper portion of the belt that extends in the horizontal direction, and a plurality of other image forming bodies that form images onto the sheet are arranged so as to face a lower portion of the belt that extends in the horizontal direction.

SUMMARY

Aspects of non-limiting embodiments of the present disclosure relate to reducing a dimension of an image forming apparatus in the horizontal direction when viewed in an axial direction of a driving roller compared with the case where the gap between a plurality of image forming bodies that are arranged along one of a plurality of linear portions of a formation target, which is configured to be transported while forming a shape having the plurality of linear portions, and the gap between a plurality of other image forming bodies that are arranged along the other of the plurality of linear portions of the formation target are the same as each other.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including a formation target that is wound around a plurality of rotating bodies including a driving roller and transported by the plurality of rotating bodies including the driving roller while forming a shape having a plurality of linear portions each of which forms a different angle, which is an acute angle or an angle of zero degrees, with a horizontal direction when viewed in an axial direction of the driving roller, a plurality of first image forming bodies that are arranged along one of the linear portions in such a manner as to be spaced apart from each other by a first distance and that form images onto the formation target, and a plurality of second image forming bodies that are arranged along another one of the linear portions, the other linear portion forming the angle larger than the angle formed by the one linear portion, in such a manner as to be spaced apart from each other by a second distance shorter than the first distance and that form images onto the formation target.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure will be described in detail below with reference to the drawings. Note that, in the following description, an upstream side and a downstream side in a transport direction of a recording sheet P, which is an example of a recording medium, will sometimes be simply referred to as an "upstream side" and a "downstream side", respectively. Similarly, an upstream side and a downstream side in a direction in which a transfer belt (a belt) (a formation target) 52 moves circularly (a transport direction) will sometimes be simply referred to as an "upstream side" and a "downstream side", respectively.

Figure 1:
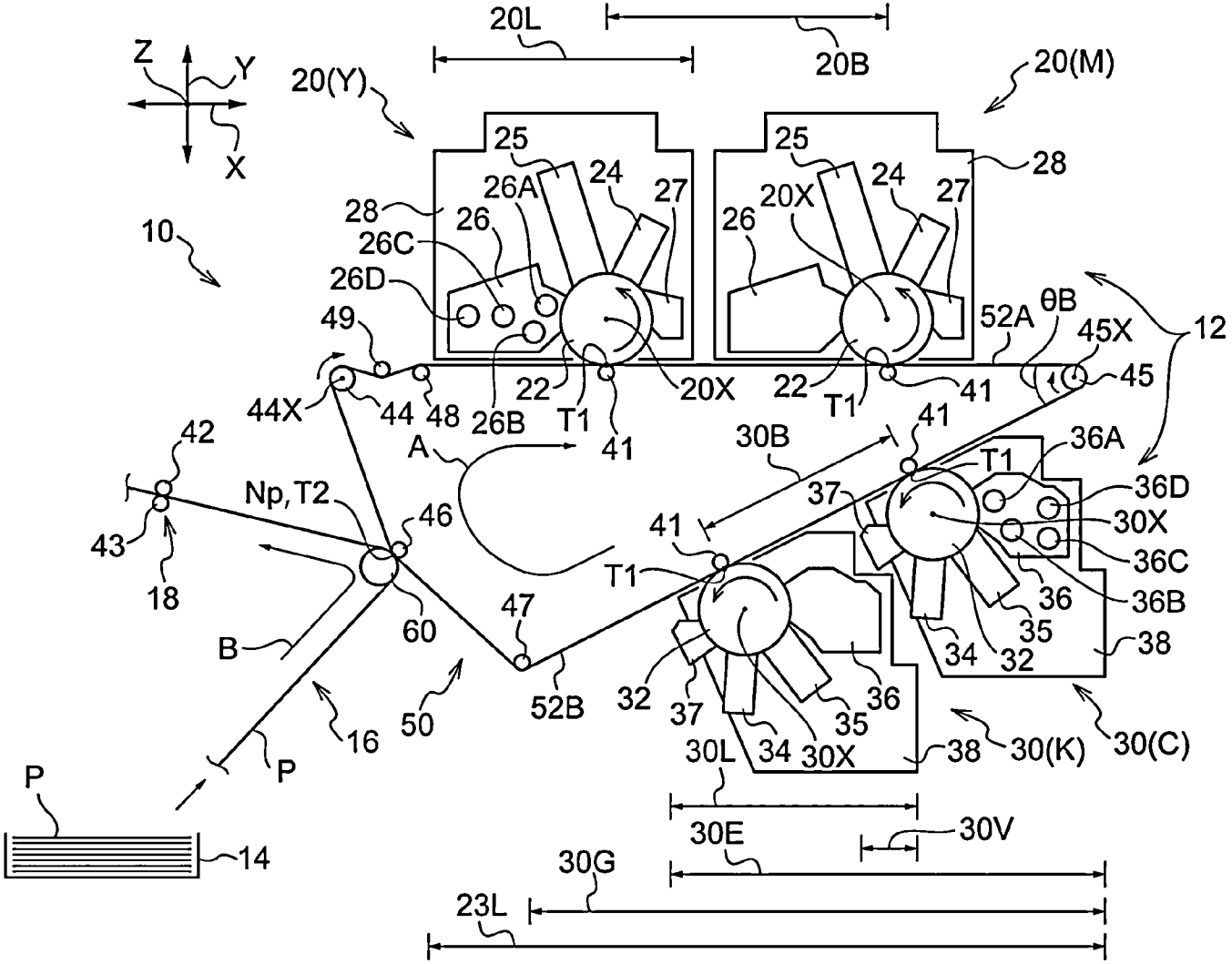
FIG. 1 is a schematic diagram illustrating a configuration of an image forming apparatus according to the present exemplary embodiment.

As illustrated in FIG. 1, an image forming apparatus 10 employs an electrophotographic system as an example and forms a toner image (an example of an image) onto the recording sheet P. The image forming apparatus 10 includes an image forming section 12, an accommodating unit 14, a transport unit 16, and a fixing device 18 that are arranged in an apparatus body (not illustrated). The components (the image forming section 12, the accommodating unit 14, the transport unit 16, and the fixing device 18) of the image forming apparatus 10 will be described below.

In addition, in the following description, the width direction of the apparatus body (the horizontal direction) and the height direction of the apparatus body (the vertical direction) are respectively defined as an X direction and a Y direction, and a direction that is perpendicular to the X direction and the Y direction (a direction perpendicular to the plane in FIG. 1) is defined as a Z direction.

<Image Forming Section>

The image forming section 12 has a function of forming toner images onto the recording sheet P. To be specific, the image forming section 12 includes first photoconductor units 20, second photoconductor units 30, and a transfer device 50.

[Photoconductor Units]

As illustrated in FIG. 1, the two first photoconductor units 20 and the two second photoconductor units 30 are provided. The first photoconductor units 20 and the second photoconductor units 30 are each capable of being mounted onto and unmounted from the apparatus body. The image forming apparatus 10 of the present exemplary embodiment includes the first photoconductor units 20Y and 20M that correspond to two colors, which are yellow (Y) and magenta (M), respectively, and the second photoconductor units 30C and 30K that correspond to other two colors, which are cyan (C) and black (K), respectively.

Note that, in the following description, when it is necessary to distinguish the photoconductor units in terms of their corresponding colors, which are yellow (Y), magenta (M), cyan (C), and black (K), the letters Y, M, C, and K will be given to the reference signs of the photoconductor units, and when it is not necessary to distinguish the photoconductor units in terms of their corresponding colors, the letters Y, M, C, and K may sometimes be omitted.

A transfer belt 52 that is included in the transfer device 50 (described later) and made of an elastic material includes two linear portions when viewed in the Z direction. These two linear portions each having a linear shape are an upper portion 52A and a lower portion 52B. When viewed in the Z direction, the upper portion 52A extends in the X direction, and the lower portion 52B is inclined with respect to the X direction. In other words, when viewed in the Z direction, an angle θB (see FIG. 1) that is formed by the lower portion 52B and the X direction is an acute angle, and the angle θB is larger than an angle θA (not illustrated) that is formed by the upper portion 52A and the X direction. Note that the angle θA is zero degrees or an acute angle slightly larger than zero degrees. When viewed in the Z direction, the upper portion 52A and the lower portion 52B are arranged side by side in the Y direction. Note that, in the present specification and the claims, the term "linear portion" is not limited to a portion having a completely linear shape. For example, although the upper portion 52A that is located between a steering roller 45 and a winding roller 48, each of which will be described later, has portions that are slightly recessed by being pushed by two first photoconductor drums 22 and two first transfer rollers 41, the upper portion 52A corresponds to the "linear portion". Similarly, although the lower portion 52B that is located between the steering roller 45 and a winding roller 47 has portions that are slightly recessed by being pushed by two second photoconductor drums 32 and other two first transfer rollers 41, the lower portion 52B corresponds to the "linear portion".

The two first photoconductor units 20 face the outer peripheral surface (the upper surface) of the upper portion 52A and are arranged side by side in the X direction along the upper portion 52A. In particular, when the two first photoconductor units 20 are arranged such that lower surfaces of support plates 28 (described later) of the first photoconductor units 20, each of the lower surfaces being formed of a flat surface, are parallel to the outer peripheral surface (the upper surface) of the upper portion 52A, the length of the apparatus body in the Y direction may be smaller than that in the case where the two first photoconductor units 20 are arranged such that the lower surfaces are not parallel to the outer peripheral surface. In addition, when the lower surfaces of the support plates 28 face the outer peripheral surface of the upper portion 52A in the Y direction, the length of the apparatus body in the Y direction may be reduced by reducing the distance between the lower surface of each of the support plates 28 and the outer peripheral surface of the upper portion 52A. Each of the first photoconductor units 20 includes one of the first photoconductor drums 22 that rotate in one direction (e.g., a counterclockwise direction in FIG. 1). Each of the first photoconductor drums 22 is rotatable about a rotary shaft 20X that extends in the Z direction. When viewed in the Z direction, the distance (adjacent distance) between the rotary shafts 20X of the two first photoconductor units 20 is a first distance 20B. Each of the first photoconductor units 20 includes a first charging unit 24, a first exposure unit 25, a first developing unit 26, and a first removal unit 27 that are arranged in this order starting from an upstream side in the direction of rotation of the first photoconductor drum 22. In addition, each of the first photoconductor units 20 includes the pair of support plates 28 that are spaced apart from each other in the Z direction. Note that one of the support plates 28 of each of the first photoconductor units 20 is not illustrated in FIG. 1. The first charging unit 24, the first exposure unit 25, the first developing unit 26, and the first removal unit 27 are members extending in the Z direction. The first charging unit 24, the first exposure unit 25, the first developing unit 26, and the first removal unit 27 each have two end portions in the Z direction each of which is supported by one of the pair of support plates 28. In addition, movement of the pair of support plates 28 relative to each other is restricted. As illustrated in FIG. 1, the dimension of each of the first photoconductor units 20 in the X direction is a horizontal dimension 20L.

The two second photoconductor units 30 face the outer peripheral surface (the lower surface) of the lower portion 52B and are arranged side by side along the lower portion 52B. Each of the second photoconductor units 30 includes one of the second photoconductor drums 32 that rotate in one direction (e.g., the counterclockwise direction in FIG. 1). Each of the second photoconductor drums 32 is rotatable about a rotary shaft 30X that extends in the Z direction. When viewed in the Z direction, the distance (adjacent distance) between the rotary shafts 30X of the two second photoconductor units 30 is a second distance 30B. Each of the second photoconductor units 30 includes a second charging unit 34, a second exposure unit 35, a second developing unit 36, and a second removal unit 37 that are arranged in this order starting from an upstream side in the direction of rotation of the second photoconductor drum 32. In addition, each of the second photoconductor units 30 includes a pair of second support plates 38 that are spaced apart from each other in the Z direction. Note that one of the second support plates 38 of each of the second photoconductor units 30 is not illustrated in FIG. 1. The second charging unit 34, the second exposure unit 35, the second developing unit 36, and the second removal unit 37 are members extending in the Z direction. The second charging unit 34, the second exposure unit 35, the second developing unit 36, and the second removal unit 37 each have two end portions in the Z direction each of which is supported by one of the pair of second support plates 38. In addition, movement of the pair of second support plates 38 relative to each other is restricted. As illustrated in FIG. 1, the dimension of each of the second photoconductor units 30 in the X direction is a horizontal dimension 30L.

In the present specification and the claims, the term "image forming body" refers to a unit that causes a toner or an ink to adhere to a formation target (e.g., the transfer belt 52). In other words, the first photoconductor drum 22 of each of the first photoconductor units 20 corresponds to a "first image forming body", and the second photoconductor drum 32 of each of the second photoconductor units 30 corresponds to a "second image forming body". That is to say, the first charging units 24, the first exposure units 25, the first developing units 26, and the first removal units 27 do not correspond to the "first image forming body". Similarly, the second charging units 34, the second exposure units 35, the second developing units 36, and the second removal units 37 do not correspond to the "second image forming body". Note that, as will be described later, in the case where the image forming apparatus 10 employs an ink-jet system, an ink jet head corresponds to an "image forming body".

As illustrated in FIG. 1, a developing roller 26A, a collecting auger 26B, a supply auger 26C, and a stirring auger 26D are arranged in each of the first developing units 26. Similarly, a developing roller 36A, a collecting auger 36B, a supply auger 36C, and a stirring auger 36D are arranged in each of the second developing units 36. In each of the first developing units 26, the supply auger 26C and the stirring auger 26D are arranged side by side in the X direction. In contrast, in each of the second developing units 36, the supply auger 36C and the stirring auger 36D are arranged side by side in the Y direction. Accordingly, the horizontal dimension of each of the second developing units 36 is shorter than the horizontal dimension of each of the first developing unit 26. Thus, the horizontal dimension 30L is shorter than the horizontal dimension 20L.

As illustrated in FIG. 1, when viewed in the Z direction, the two first photoconductor units 20 are arranged side by side in the X direction. In other words, the two first photoconductor units 20 are not arranged side by side in the Y direction. In contrast, when viewed in the Z direction, portions of the two second photoconductor units 30 are arranged side by side in the Y direction. A horizontal dimension 30V that is illustrated in FIG. 1 is a dimension of these portions of the two second photoconductor units 30 in the X direction. In FIG. 1, reference sign 30E denotes a horizontal dimension of a portion formed of the two second photoconductor units 30. In FIG. 1, reference sign 30G denotes a horizontal dimension of a portion formed of the lower portion 52B and the two second photoconductor units 30.

In each of the first photoconductor units 20, the first charging unit 24 electrically charges the outer peripheral surface of the first photoconductor drum 22. Then, the first exposure unit 25 exposes the outer peripheral surface of the first photoconductor drum 22, which has been charged by the first charging unit 24, to light so as to form an electrostatic latent image onto the outer peripheral surface of the first photoconductor drum 22. In addition, the first developing unit 26 develops the electrostatic latent image, which has been formed on the outer peripheral surface of the first photoconductor drum 22 by the first exposure unit 25, into a toner image. After that, the first removal unit 27 removes toner that remains on the outer peripheral surface of the first photoconductor drum 22 after the toner image has been transferred to the transfer belt 52.

In each of the second photoconductor units 30, the second charging unit 34 electrically charges the outer peripheral surface of the second photoconductor drum 32. Then, the second exposure unit 35 exposes the outer peripheral surface of the second photoconductor drum 32, which has been charged by the second charging unit 34, to light so as to form an electrostatic latent image onto the outer peripheral surface of the second photoconductor drum 32. In addition, the second developing unit 36 develops the electrostatic latent image, which has been formed on the outer peripheral surface of the second photoconductor drum 32 by the second exposure unit 35, into a toner image. After that, the second removal unit 37 removes toner that remains on the outer peripheral surface of the second photoconductor drum 32 after the toner image has been transferred to the transfer belt 52.

[Transfer Device]

As illustrated in FIG. 1, the transfer device 50 includes the four first transfer rollers 41, each of which is an example of a first transfer body, the transfer belt 52, which is an example of an intermediate transfer body, and a transfer drum 60, which is an example of a second transfer body. In other words, the transfer device 50 transfers, in a first transfer process, toner images formed on the outer peripheral surfaces of the first photoconductor drums 22 onto the transfer belt 52 such that the toner images are superposed with each other and transfers, in a second transfer process, the superposed toner images onto the recording sheet P.

(First Transfer Rollers)

As illustrated in FIG. 1, each of the first transfer rollers 41 facing the upper portion 52A transfers a toner image formed on the outer peripheral surface of the corresponding first photoconductor drum 22 onto the outer peripheral surface of the transfer belt 52 at a first transfer position T1 between the first photoconductor drum 22 and the first transfer roller 41. Each of the first transfer rollers 41 facing the lower portion 52B transfers a toner image formed on the outer peripheral surface of the corresponding second photoconductor drum 32 onto the outer peripheral surface of the transfer belt 52 at the first transfer position T1 between the second photoconductor drum 32 and the first transfer roller 41. The distance between the first transfer positions T1 of the two first photoconductor drums 22 corresponds to the first distance 20B. Similarly, the distance between the first transfer positions T1 of the two second photoconductor drums 32 corresponds to the second distance 30B. In the present exemplary embodiment, as a result of a first transfer voltage being applied between each of the first transfer rollers 41 and the corresponding first photoconductor drum 22, the toner images formed on the outer peripheral surfaces of the first photoconductor drums 22 are transferred onto the outer peripheral surface of the transfer belt 52 at their respective first transfer positions T1. Similarly, as a result of the first transfer voltage being applied between each of the first transfer rollers 41 and the corresponding second photoconductor drum 32, the toner images formed on the outer peripheral surfaces of the second photoconductor drums 32 are transferred onto the outer peripheral surface of the transfer belt 52 at their respective first transfer positions T1.

(Transfer Belt)

As illustrated in FIG. 1, the transfer belt 52 is formed in an annular shape and has an outer peripheral surface onto which toner images are transferred. The transfer belt 52 is wound around a driving roller 44, the steering roller (rotating body) 45, a backup roller (rotating body) 46, the winding roller (rotating body) 47, the winding roller (rotating body) 48, and a pushing roller (rotating body) 49, so that the arrangement thereof is fixed.

The driving roller 44 that has a circular cross section is configured to be driven by a driving unit (not illustrated) so as to rotate about an axis 44X that extends in the Z direction, so that the driving roller 44 causes the transfer belt 52 to move along a circular path in the direction indicated by arrow A at a predetermined speed.

The diameter of the steering roller 45 that has a circular cross section and the diameter of the driving roller 44 are the same within a tolerance range. In other words, an outer peripheral length 45C of the steering roller 45 and an outer peripheral length 44C of the driving roller 44 are the same within a tolerance range. The steering roller 45 is rotatable about an axis 45X that extends in the Z direction. In addition, the steering roller 45 is swingable about a center portion thereof in the direction in which the axis 45X extends. Thus, a serpentine movement of the transfer belt 52 is suppressed by the steering roller 45.

The first distance 20B between the two first photoconductor drums 22 and the second distance 30B between the two second photoconductor drums 32 are each set to be an integral multiple of the outer peripheral length 44C of the driving roller 44 and the outer peripheral length 45C of the steering roller 45. The second distance 30B is shorter than the first distance 20B. In the present exemplary embodiment, for example, the first distance 20B is set to four times the outer peripheral length 44C and the outer peripheral length 45C, and the second distance 30B is set to three times the outer peripheral length 44C and the outer peripheral length 45C.

The distance between the first transfer position T1 of the first photoconductor drum 22 on the downstream side and the first transfer position T1 of the second photoconductor drum 32 on the upstream side along the transfer belt 52 is a distance that is different from both the first distance 20B and the second distance 30B. In other words, the distance between the first transfer position T1 of the first photoconductor drum 22 on the downstream side and the first transfer position T1 of the second photoconductor drum 32 on the upstream side along the transfer belt 52 does not correspond to either a "first distance" or a "second distance" in the claims. The distance between the first transfer position T1 of the first photoconductor drum 22 on the downstream side and the first transfer position T1 of the second photoconductor drum 32 on the upstream side along the transfer belt 52 is also set to be an integral multiple of the outer peripheral length 44C of the driving roller 44 and the outer peripheral length 45C of the steering roller 45.

The backup roller 46 faces the transfer drum 60 with the transfer belt 52 interposed therebetween. A contact region in which the transfer drum 60 and the transfer belt 52 are in contact with each other is a nip region Np (see FIG. 1). This nip region Np corresponds to a second transfer position T2 at which toner images are transferred from the transfer belt 52 onto the recording sheet P.

Figure 2:
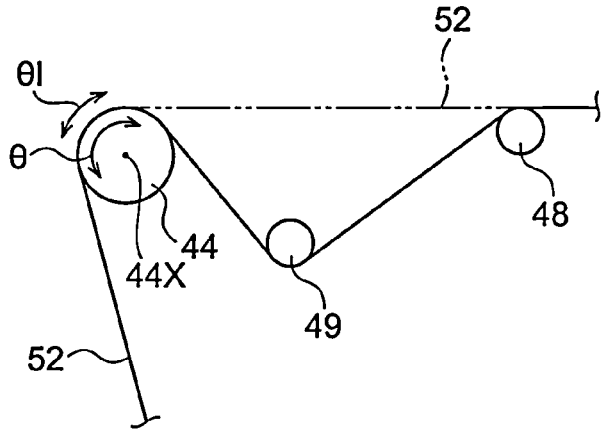
FIG. 2 is a side view illustrating a transfer belt, a driving roller, a winding roller, and a pushing roller according to the present exemplary embodiment.

The winding roller 47 that is positioned downstream from the second photoconductor unit 30K and upstream from the backup roller 46 is rotatably in contact with the inner peripheral surface of the transfer belt 52. The winding roller 48 that is positioned upstream from the first photoconductor unit 20Y and downstream from the driving roller 44 is rotatably in contact with the inner peripheral surface of the transfer belt 52. In addition, the pushing roller 49 that is positioned upstream from the winding roller 48 and downstream from the driving roller 44 is rotatably in contact with the outer peripheral surface of the transfer belt 52 and pushes the transfer belt 52 toward the inner periphery side. In the case where the pushing roller 49 is not provided, a portion of the transfer belt 52 that is located between the driving roller 44 and the winding roller 48 has a shape that is indicated by an imaginary line in FIG. 2. In this case, the wrap angle between the transfer belt 52 and the drive roll 44 is a wrap angle θ1. In contrast, since the pushing roller 49 is provided in the present exemplary embodiment, the wrap angle between the transfer belt 52 and the driving roller 44 is a wrap angle θ. As is clear from FIG. 2, the wrap angle θ is larger than the wrap angle θ1.

<Transport Unit>

As illustrated in FIG. 1, the transport unit 16 includes a transport device (not illustrated) that transports the recording sheet P, which is sent out from the accommodating unit 14, in the direction of arrow B. The recording sheet P sent out from the accommodating unit 14 is transported to the transfer drum 60 by the transport device. Toner images are transferred in the second transfer process onto the recording sheet P as a result of the recording sheet P passing through the transfer drum 60 (the second transfer position T2), after which the recording sheet P is transported to the fixing device 18 by the transport device.

<Fixing Device>

As illustrated in FIG. 1, the fixing device 18 includes a heating roller 42, which is an example of a heating member, and a pressure roller 43, which is an example of a pressing member. The fixing device 18 applies heat and pressure to the recording sheet P by nipping the recording sheet P between the heating roller 42 and the pressure roller 43 so as to fix the toner images, which have been transferred to the recording sheet P by the transfer drum 60, onto the recording sheet P.

Operations and effects of the image forming apparatus 10 having a configuration such as that described above will now be described in detail.

As described above, when viewed in the Z direction, the angle θB, which is the acute angle formed by the lower portion 52B having a linear shape and the horizontal direction (the X direction), is larger than the angle θA formed by the upper portion 52A having a linear shape and the horizontal direction. In addition, the two second photoconductor units 30 are arranged along the lower portion 52B. Furthermore, the second distance 30B, which is the distance (adjacent distance) between the two rotary shafts 30X when viewed in the Z direction is shorter than the first distance 20B, which is the distance (adjacent distance) between the two rotary shafts 20X. Thus, the horizontal dimension 30G of the portion formed of the lower portion 52B and the two second photoconductor units 30 is smaller than that in the case where the gap between the plurality of image forming bodies (the first photoconductor drums 22) that are arranged along the upper portion 52A and the gap between the plurality of image forming bodies (the second photoconductor drums 32) that are arranged along the lower portion 52B are the same as each other. Therefore, the horizontal dimension of the image forming apparatus 10 when viewed in the Z direction is smaller than that in the case where the gap between the plurality of image forming bodies that are arranged along the upper portion 52A and the gap between the plurality of image forming bodies that are arranged along the lower portion 52B are the same as each other.

The upper portion 52A and the lower portion 52B are arranged side by side in the Y direction. Consequently, a horizontal dimension 23L of a portion formed of the upper portion 52A and the lower portion 52B is smaller than that in the case where the upper portion 52A and the lower portion 52B are positioned so as to be spaced apart from each other in the horizontal direction. Thus, the horizontal dimension of the image forming apparatus 10 when viewed in the Z direction is smaller than that in the case where the upper portion 52A and the lower portion 52B are positioned so as to be spaced apart from each other in the horizontal direction.

In addition, the horizontal dimension 30L of each of the second photoconductor units 30 is shorter than the horizontal dimension 20L of each of the first photoconductor units 20. Thus, the horizontal dimension of the image forming apparatus 10 when viewed in the Z direction is smaller than that in the case where the horizontal dimension 30L is equal to or larger than the horizontal dimension 20L.

When viewed in the Z direction, portions of the two second photoconductor units 30 are arranged side by side in the height direction (the Y direction). Consequently, when viewed in the Z direction, the horizontal dimension 30E of the portion formed of the two second photoconductor units 30 is smaller than that in the case where the two second photoconductor units 30 are arranged so as to be spaced apart from each other in the X direction. Thus, when viewed in the Z direction, the horizontal dimension of the image forming apparatus 10 is smaller than that in the case where the two second photoconductor units 30 are arranged so as to be spaced apart from each other in the X direction.

The first distance 20B between the two first photoconductor drums 22 and the second distance 30B between the two second photoconductor drums 32 are each set to be an integral multiple of the outer peripheral length 44C of the driving roller 44.

Although the image forming apparatus 10 according to the present exemplary embodiment has been described above with reference to the drawings, the image forming apparatus 10 according to the present exemplary embodiment is not limited to that illustrated in the drawings, and design changes may be suitably made within the gist of the present disclosure.

Figure 3:
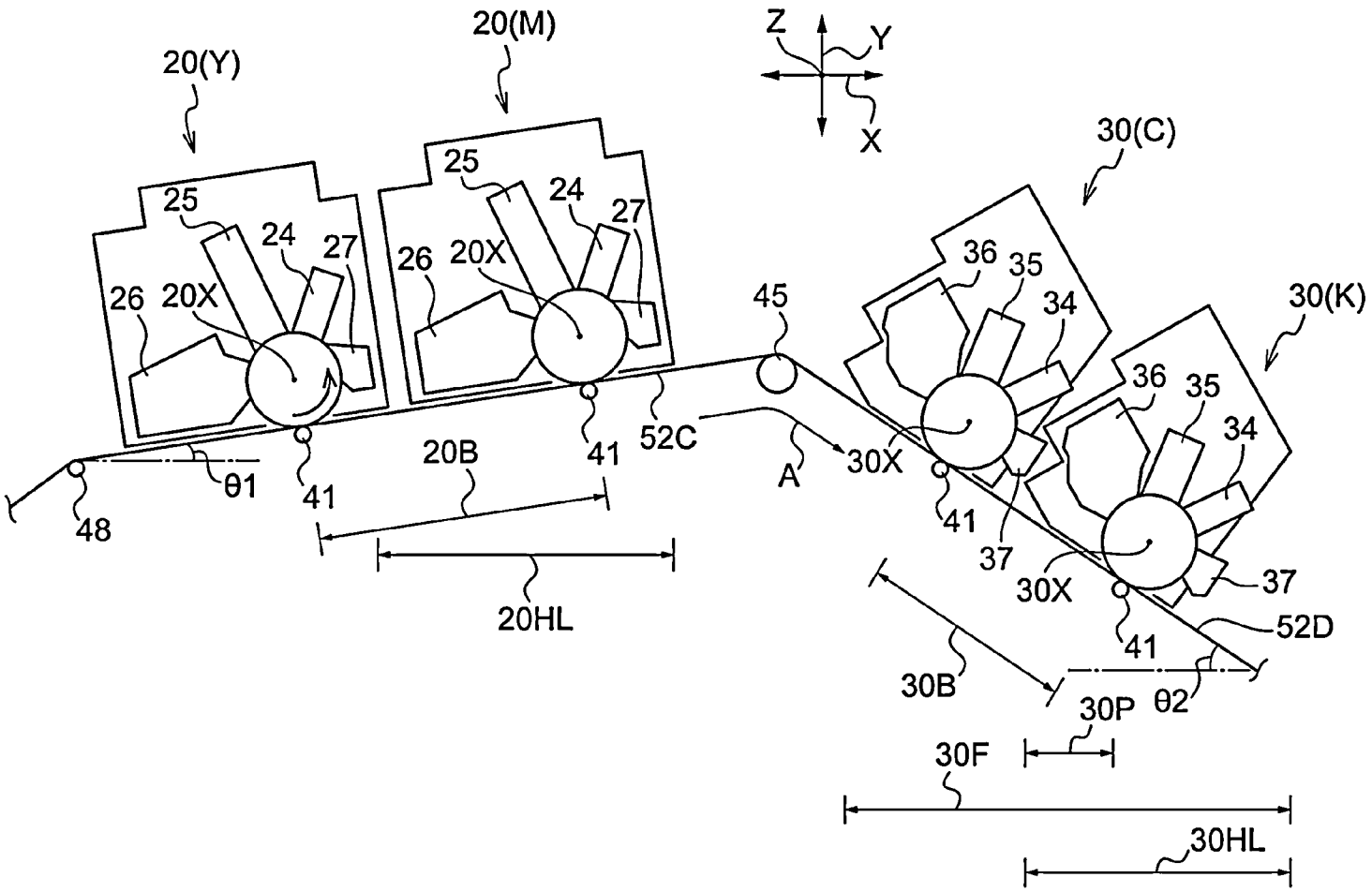
FIG. 3 is a schematic diagram illustrating a configuration of a portion of an image forming apparatus according to a modification of the present exemplary embodiment.

For example, the image forming apparatus 10 may be implemented in an aspect of a modification illustrated in FIG. 3 (the developing rollers 26A, the collecting augers 26B, the supply augers 26C, the stirring augers 26D, the developing rollers 36A, the collecting augers 36B, the supply augers 36C, and the stirring augers 36D are not illustrated in FIG. 3). In the image forming apparatus 10 of the modification, the acute angle formed by an upstream portion 52C of the transfer belt 52 and the X direction is an angle θ1. The upstream portion 52C of the transfer belt 52 is a linear portion and is positioned upstream from the steering roller 45 and downstream from the winding roller 48. The acute angle formed by a downstream portion 52D that is positioned downstream from the steering roller 45 and that is a linear portion continuous with the upstream portion 52C and the X direction is an angle θ2 that is larger than the angle θ1. As is clear from FIG. 3, the upstream portion 52C and the downstream portion 52D are not arranged side by side in the Y direction and arranged side by side in the X direction. The two first photoconductor units 20 are arranged along the upper surface (the outer peripheral surface) of the upstream portion 52C, and the two second photoconductor units 30 are arranged along the upper surface (the outer peripheral surface) of the downstream portion 52D. The first photoconductor units 20 of the modification each have a configuration the same as that of each of the first photoconductor units 20 of the exemplary embodiment, and the second photoconductor units 30 of the modification each have a configuration the same as that of each of the second photoconductor units 30 of the exemplary embodiment.

The distance (adjacent distance) between the rotary shafts 20X of the two first photoconductor units 20 when viewed in the Z direction is the first distance 20B. The distance (adjacent distance) between the rotary shafts 30X of the two second photoconductor units 30 when viewed in the Z direction is the second distance 30B. As illustrated in FIG. 3, each of the first photoconductor units 20 has a horizontal dimension 20HL, and each of the second photoconductor units 30 has a horizontal dimension 30HL. The horizontal dimension 30HL is shorter than the horizontal dimension 20HL.

When viewed in the Z direction, portions of the two second photoconductor units 30 are arranged side by side in the Y direction. A horizontal dimension 30P that is illustrated in FIG. 3 is a dimension of these portions of the two second photoconductor units 30 in the X direction. In FIG. 3, reference sign 30F denotes a dimension of a portion formed of the two second photoconductor units 30. The horizontal dimension 30P is larger than the horizontal dimension 30V illustrated in FIG. 1. Thus, the horizontal dimension 30F is smaller than the horizontal dimension 30E illustrated in FIG. 1.

In the image forming apparatus 10 of the modification illustrated in FIG. 3, the angle θ2 is larger than the angle θ1. In addition, the two second photoconductor units 30 are arranged along the downstream portion 52D. Furthermore, the second distance 30B is shorter than the first distance 20B. Thus, the dimension of a portion formed of the downstream portion 52D and the two second photoconductor units 30 is smaller than that in the case where the gap between the plurality of image forming bodies (the first photoconductor drums 22) that are arranged along the upstream portion 52C and the gap between the plurality of image forming bodies (the second photoconductor drums 32) that are arranged along the downstream portion 52D are the same as each other. Therefore, the horizontal dimension of the image forming apparatus 10 of the modification when viewed in the Z direction is smaller than that in the case where the gap between the plurality of image forming bodies that are arranged along the upstream portion 52C and the gap between the plurality of image forming bodies that are arranged along the downstream portion 52D are the same as each other.

In addition, the horizontal dimension 30HL of each of the two second photoconductor units 30 is shorter than the horizontal dimension 20HL of each of the first photoconductor units 20. Thus, the horizontal dimension of the image forming apparatus 10 of the modification when viewed in the Z direction is smaller than that in the case where the horizontal dimension 30HL is equal to or larger than the horizontal dimension 20HL.

Furthermore, when viewed in the Z direction, portions of the two second photoconductor units 30 are arranged side by side in the Y direction. Consequently, when viewed in the Z direction, the horizontal dimension 30F of the portion formed of the two second photoconductor units 30 is smaller than that in the case where the two second photoconductor units 30 are arranged so as to be spaced apart from each other in the X direction. Thus, when viewed in the Z direction, the horizontal dimension of the image forming apparatus 10 of the modification is smaller than that in the case where the two second photoconductor units 30 are arranged so as to be spaced apart from each other in the X direction.

The image forming apparatus 10 may be configured in such a manner that the first photoconductor units 20 and the second photoconductor units 30 form toner images onto the recording sheet P (a formation target) that is transported by a transport belt (not illustrated) that is provided instead of the transfer belt 52.

Although toner images have been mentioned as examples of an image, and a case has been described in which the toner images are formed by a dry electrophotographic system, the present disclosure is not limited to this case. For example, the toner images may be formed by a wet electrophotographic system or may be images formed by an ink-jet system.

Alternatively, the image forming apparatus 10 may be configured in such a manner that an image formed by using an ink or a toner image is formed onto a continuous sheet (a formation target) that is long and that does not have an annular shape, the continuous sheet being wound around the plurality of rotating bodies including the driving roller 44 and transported by the plurality of rotating bodies including the driving roller 44 while forming a shape having a plurality of linear portions each of which forms a different angle, which is an acute angle or an angle of zero degrees, with the horizontal direction when viewed in the direction in which axis 44X extends.

In the case where the image forming apparatus 10 employs an ink-jet system, a first distance that is the distance between center portions of ink jet heads (first image forming bodies) that correspond to the first photoconductor units 20 and a second distance that is the distance between center portions of ink jet heads (second image forming bodies) that correspond to the second photoconductor units 30 are each set to be an integral multiple of the outer peripheral length 44C and the outer peripheral length 45C.

In the case where the image forming apparatus 10 includes all of the first photoconductor units 20, the second photoconductor units 30, and an ink jet head, each of the first distance and the second distance does not need to be an integral multiple of the outer peripheral length 44C and the outer peripheral length 45C.

The diameter of the steering roller 45 and the diameter of the driving roller 44 may be different from each other. In this case, however, the diameter of the steering roller 45 and the diameter of the driving roller 44 may be set in such a manner that each of the adjacent distances (the first distance 20B and the second distance 30B) is an integral multiple of the outer peripheral length 44C and the outer peripheral length 45C.

The number of colors of images (toner images, ink images) that are formed onto a formation target (the transfer belt 52, the recording medium P) does not need to be four. The number of colors of the images may be, for example, six.

For example, in the case where three or more first photoconductor units 20 are arranged along the upper portion 52A or the upstream portion 52C, a plurality of first distances may be all the same within a tolerance range. Alternatively, the first distances may be different from each other, or at least one of the first distances may be different from the other first distances. Note that the wording "all the first distances are the same" in the claims refers to the case where all the plurality of first distances are the same within a tolerance range. For example, the first distance between the most downstream first photoconductor unit 20 and the first photoconductor unit 20 that is adjacent to the most downstream first photoconductor unit 20 may be shorter than the first distance between the most upstream first photoconductor unit 20 and the first photoconductor unit 20 that is adjacent to the most upstream first photoconductor unit 20.

For example, in the case where three or more second photoconductor units 30 are arranged along the lower portion 52B or the downstream portion 52D, a plurality of second distances may be all the same within a tolerance range. Alternatively, the second distances may be different from each other, or at least one of the second distances may be different from the other second distances. Note that the wording "all the second distances are the same" in the claims refers to the case where all the plurality of second distances are the same within a tolerance range. For example, the second distance between the most downstream second photoconductor unit 30 and the second photoconductor unit 30 that is adjacent to the most downstream second photoconductor unit 30 may be shorter than the second distance between the most upstream second photoconductor unit 30 and the second photoconductor unit 30 that is adjacent to the most upstream second photoconductor unit 30.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a formation target that is wound around a plurality of rotating bodies including a driving roller and transported by the plurality of rotating bodies including the driving roller while forming a shape having a plurality of linear portions each of which forms a different angle, which is an acute angle or an angle of zero degrees, with a horizontal direction when viewed in an axial direction of the driving roller;

a plurality of first image forming bodies that are arranged along one of the linear portions in such a manner as to be spaced apart from each other by a first distance and that form images onto the formation target; and a plurality of second image forming bodies that are arranged along another one of the linear portions, the other linear portion forming the angle larger than the angle formed by the one linear portion, in such a manner as to be spaced apart from each other by a second distance shorter than the first distance and that form images onto the formation target.

2. An image forming apparatus comprising:

an annular belt that is wound around a plurality of rotating bodies including a driving roller and that moves along a circular path while having a plurality of linear portions each of which forms a different angle, which is an acute angle or an angle of zero degrees, with a horizontal direction when viewed in an axial direction of the driving roller;

a plurality of first image forming bodies that are arranged along one of the linear portions in such a manner as to be spaced apart from each other by a first distance and that form images onto a formation target, the formation target being the belt or a recording medium transported by the belt; and a plurality of second image forming bodies that are arranged along another one of the linear portions, the other linear portion forming the angle larger than the angle formed by the one linear portion, in such a manner as to be spaced apart from each other by a second distance shorter than the first distance and that form images onto the formation target.

3. The image forming apparatus according to claim 1, wherein the plurality of first image forming bodies are three or more first image forming bodies that are arranged along the one linear portion, and wherein all the first distances are the same.

4. The image forming apparatus according to claim 2, wherein the plurality of first image forming bodies are three or more first image forming bodies that are arranged along the one linear portion, and wherein all the first distances are the same.

5. The image forming apparatus according to claim 1, wherein the plurality of second image forming bodies are three or more second image forming bodies that are arranged along the other linear portion, and wherein all the second distances are the same.

6. The image forming apparatus according to claim 2, wherein the plurality of second image forming bodies are three or more second image forming bodies that are arranged along the other linear portion, and wherein all the second distances are the same.

7. The image forming apparatus according to claim 3, wherein the plurality of second image forming bodies are three or more second image forming bodies that are arranged along the other linear portion, and wherein all the second distances are the same.

8. The image forming apparatus according to claim 4, wherein the plurality of second image forming bodies are three or more second image forming bodies that are arranged along the other linear portion, and wherein all the second distances are the same.

9. The image forming apparatus according to claim 1, wherein the first distance and the second distance are each an integral multiple of an outer peripheral length of the driving roller.

10. The image forming apparatus according to claim 2, wherein the first distance and the second distance are each an integral multiple of an outer peripheral length of the driving roller.

11. The image forming apparatus according to claim 3, wherein the first distance and the second distance are each an integral multiple of an outer peripheral length of the driving roller.

12. The image forming apparatus according to claim 4, wherein the first distance and the second distance are each an integral multiple of an outer peripheral length of the driving roller.

13. The image forming apparatus according to claim 5, wherein the first distance and the second distance are each an integral multiple of an outer peripheral length of the driving roller.

14. The image forming apparatus according to claim 6, wherein the first distance and the second distance are each an integral multiple of an outer peripheral length of the driving roller.

15. The image forming apparatus according to claim 7, wherein the first distance and the second distance are each an integral multiple of an outer peripheral length of the driving roller.

16. The image forming apparatus according to claim 8, wherein the first distance and the second distance are each an integral multiple of an outer peripheral length of the driving roller.

17. The image forming apparatus according to claim 1, wherein the one linear portion and the other linear portion are arranged side by side in a vertical direction.

18. The image forming apparatus according to claim 1, wherein each of the first image forming bodies is a first photoconductor drum that transfers a toner image onto the formation target, wherein each of the second image forming bodies is a second photoconductor drum that transfers a toner image onto the formation target, and wherein a distance between rotary shafts of the first photoconductor drums that are adjacent to each other is the first distance, and a distance between rotary shafts of the second photoconductor drums that are adjacent to each other is the second distance.

19. The image forming apparatus according to claim 18, wherein a plurality of first photoconductor units each of which has a structure in which one of the first photoconductor drums, a first charging unit that electrically charges the photoconductor drum, a first exposure unit that exposes the first photoconductor drum to light, and a first developing unit that causes a toner to adhere to the first photoconductor drum are integrated with one another are arranged along the one linear portion, wherein a plurality of second photoconductor units each of which has a structure in which one of the second photoconductor drums, a second charging unit that electrically charges the photoconductor drum, a second exposure unit that exposes the second photoconductor drum to light, and a second developing unit that causes a toner to adhere to the second photoconductor drum are integrated with one another are arranged along the one linear portion, and wherein, when viewed from the axial direction, a dimension of each of the second photoconductor units in the horizontal direction is smaller than a dimension of each of the first photoconductor units in the horizontal direction.

20. The image forming apparatus according to claim 19, wherein, when viewed from the axial direction, portions of the second photoconductor units that are adjacent to each other are arranged side by side in a vertical direction.

* * * * *